US005934940A

United States Patent [19]

Maranto et al.

[11] Patent Number: 5,934,940

[45] Date of Patent: Aug. 10, 1999

[54] SHIELDED ELECTRICAL CONNECTOR

[75] Inventors: Keith Samuel Maranto, Frankfort; James T. Roberts, Oak Park, both of Ill.

[73] Assignee: Molex Incorporated, Lisle, Ill.

[21] Appl. No.: 08/899,110

[22] Filed: Jul. 23, 1997

[51] Int. Cl.[6] ..... H01R 13/648

[52] U.S. Cl. ..... 439/607; 439/108

[58] Field of Search ..... 439/607–609, 439/108, 676, 567

[56] References Cited

U.S. PATENT DOCUMENTS

| | | | |
|---|---|---|---|
| 4,780,570 | 10/1988 | Chuck | 174/35 GC |
| 4,906,201 | 3/1990 | Young et al. | 439/609 |
| 4,959,024 | 9/1990 | Czeschka | 439/607 |
| 5,015,802 | 5/1991 | Chi | 439/609 |
| 5,067,914 | 11/1991 | Seidel et al. | 439/609 |
| 5,429,528 | 7/1995 | Longueville et al. | 439/608 |
| 5,443,392 | 8/1995 | Longueville et al. | 439/108 |
| 5,496,195 | 3/1996 | Reed | 439/607 |
| 5,623,015 | 4/1997 | Tan et al. | 439/609 |
| 5,735,712 | 4/1998 | Hass et al. | 439/609 |

*Primary Examiner*—Hien Vu

*Attorney, Agent, or Firm*—Stephen Z. Weiss

[57] ABSTRACT

A shielded electrical connector is adapted to be secured within an opening in a panel. The connector includes a dielectric housing having at least one cavity extending interiorly from a front mating face of the housing for receiving a complementary mating plug connector. A shield is stamped and formed from sheet metal material in a configuration to embrace at least a portion of the housing. The shield includes a generally planar wall insertable into the opening in the panel. A cantilevered tab is struck from the wall and has a secured end and a free end such that the free end extends from the secured end in a direction generally transverse to a direction of insertion of the connector into the panel. The cantilevered tab is generally U-shaped with leg portions of the tab extending generally parallel to the front mating face of the dielectric housing.

12 Claims, 4 Drawing Sheets

SHIELDED ELECTRICAL CONNECTOR

FIELD OF THE INVENTION

This invention generally relates to the art of electrical connectors and, particularly, to a shielded electrical connector having improved grounding tabs.

BACKGROUND OF THE INVENTION

Shielded electrical connectors have been used for many years in a wide variety of applications. In high speed and other telecommunication and computer applications, it is important to shield the transmitted signals at a connection interface to prevent the ingress and egress of radiated emissions. For instance, shielded modular jacks are well known in the electronics industry. The shielding of these jacks reduces the transmission of noise and reduces the sensitivity to external noise, thereby allowing a higher data transmission speed than with non-shielded modular jacks. In other words, due to the ever-increasing data transmission speeds, and with the close spacing of juxtaposed conductors in the modular jacks, excessive noise (cross talk) limits the data transmission speed capability of modular jacks.

Shielded electrical connectors, such as modular jacks, often are mounted within a metal panel or chassis, generally from the rear. At least portions of the shield of the connector or jack project outwardly in grounding contact with the metal panel or chassis. Typically, the shield has cantilevered tabs struck from the walls of the metal shield, the tabs having free ends for engaging the metal chassis. The cantilevered tabs are elongated, and in some connectors of the prior art the tabs extend forwardly from a rear location toward a front surface of the connector. In other connectors of the prior art, the tabs extend from the front surface of the connector rearwardly toward a rearward location. In either instance, the elongated tabs extend in the insertion/removal direction of the connector into and out of the metal chassis. Problems have been encountered with such grounding means of the prior art because the elongated metal tabs have a tendency to buckle under stresses, particularly if the tabs become hooked or jammed during insertion or removal of the connector. In some connectors of the prior art, the housings even have been cut-away to accommodate and protect the distal ends of the grounding tabs. This requires customizing the housing, by providing cut outs to accommodate the tabs and protect them from buckling in use.

The present invention is directed to solving the above problems in a shielded electrical connector such as a shielded modular jack.

SUMMARY OF THE INVENTION

An object, therefore, of the invention is to provide a shielded electrical connector with an improved grounding means for facilitating mounting the connector within an opening in a panel, such as a metal chassis housing.

In the exemplary embodiment of the invention, the shielded electrical connector includes a dielectric housing having at least one cavity extending interiorly from a front mating face of the housing for receiving a complementary mating plug connector. A shield is stamped and formed from sheet metal material in a configuration to embrace at least a portion of the housing. The shield includes a planar wall insertable into the opening in the panel. A cantilevered tab is struck from the wall of the sheet metal shield and has a secured end and a free end such that the free end extends from the secured end in a direction generally transverse to a direction of insertion of the connector into the panel. Preferably, the free end of the transverse cantilevered tab is rounded and projects outwardly of the plane of the wall of the shield.

As disclosed herein, the cantilevered tab is generally U-shaped, defining a pair of leg portions joined by a bight portion, with adjacent ends of the leg portions defining the secured end of the tab and the bight portion defining the free end of the tab. The leg portions extend generally parallel to the front mating face of the dielectric housing. The bight portion is rounded and projects outwardly of the plane of the wall of the shield.

Finally, the metal shield preferably is stamped and formed as a one-piece structure. As disclosed herein, the dielectric housing includes a plurality of cavities for receiving a plurality of the mating plug connectors. The connector is adapted for mounting to a printed circuit board, and the shield includes board-mounting feet.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
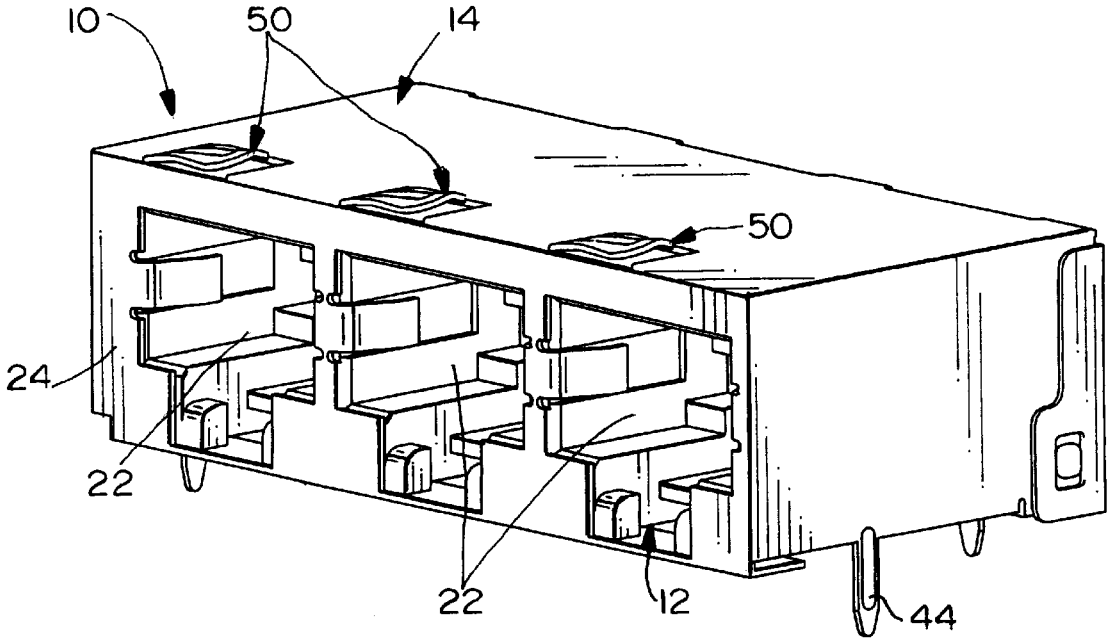
FIG. 1 is a front perspective view of a shielded electrical connector embodying the concepts of the invention.
Figure 2:
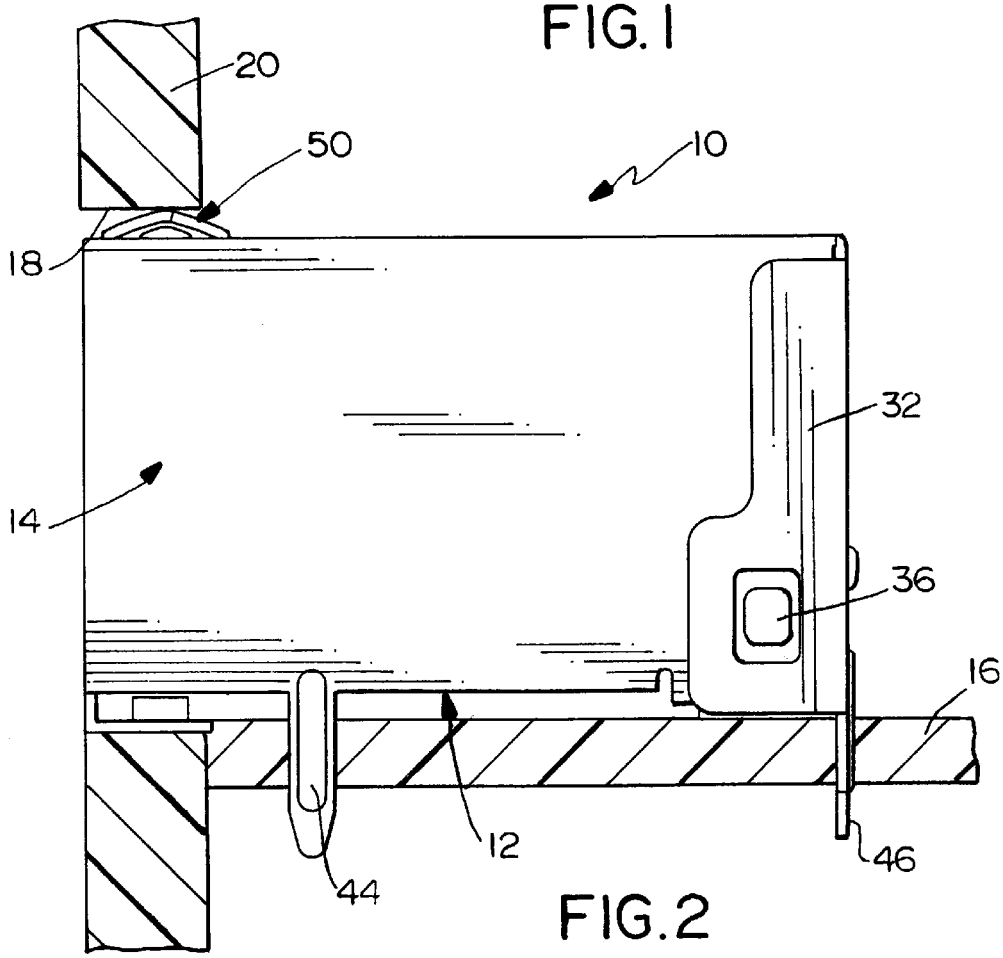
FIG. 2 is a side elevational view of the connector, mounted to a printed circuit board and secured within an opening in a panel.
Figure 3:
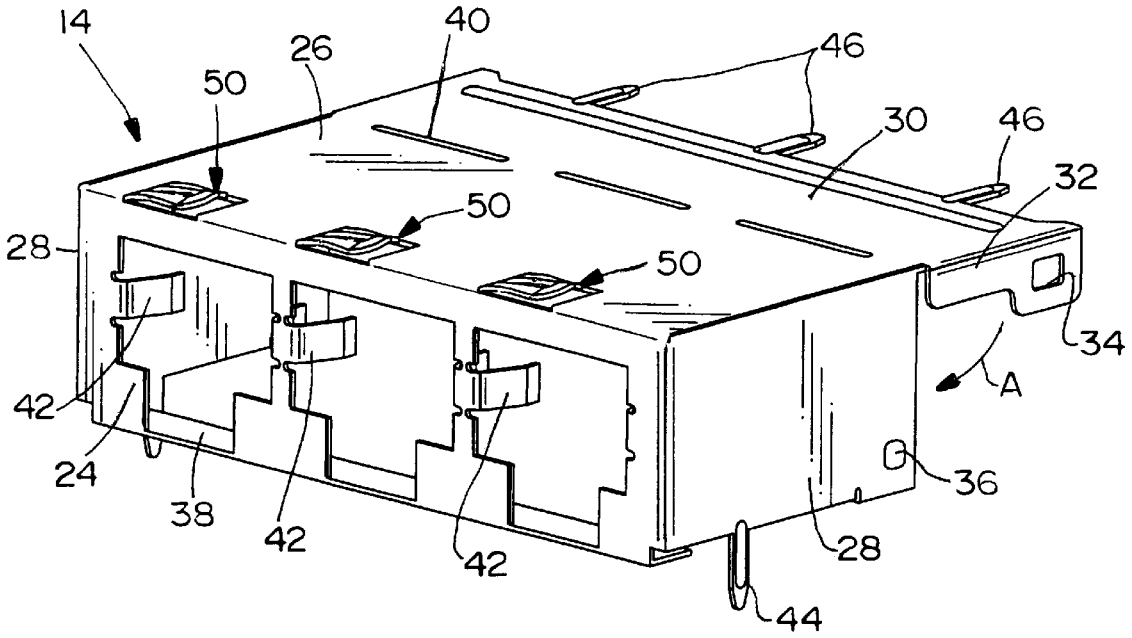
FIG. 3 is a front perspective view of the shield of the connector prior to assembly to the connector housing.
Figure 4:
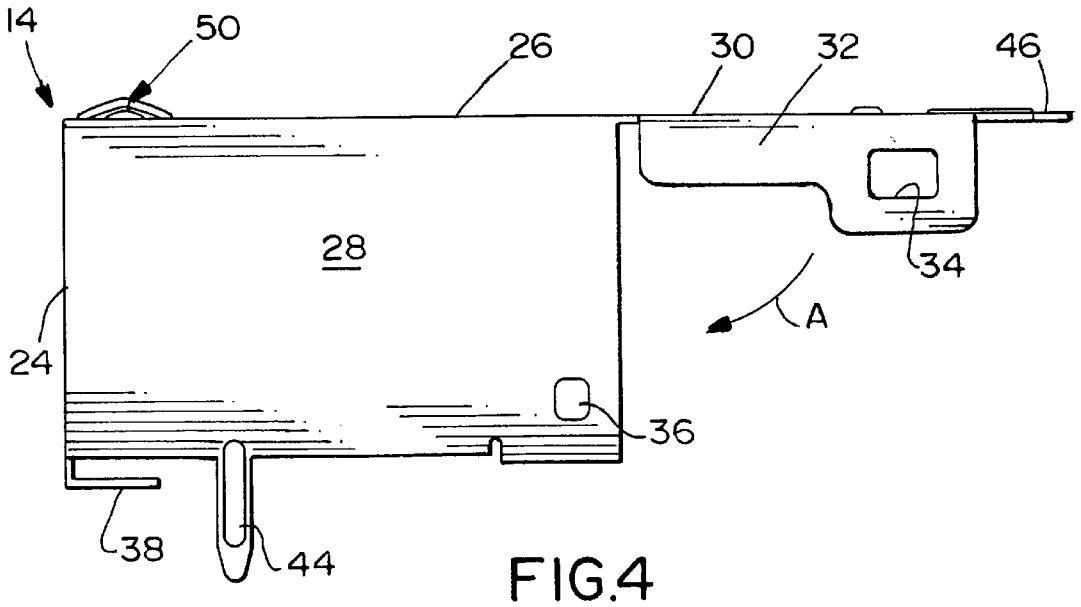
FIG. 4 is a side elevational view of the unassembled shield.
Figure 5:
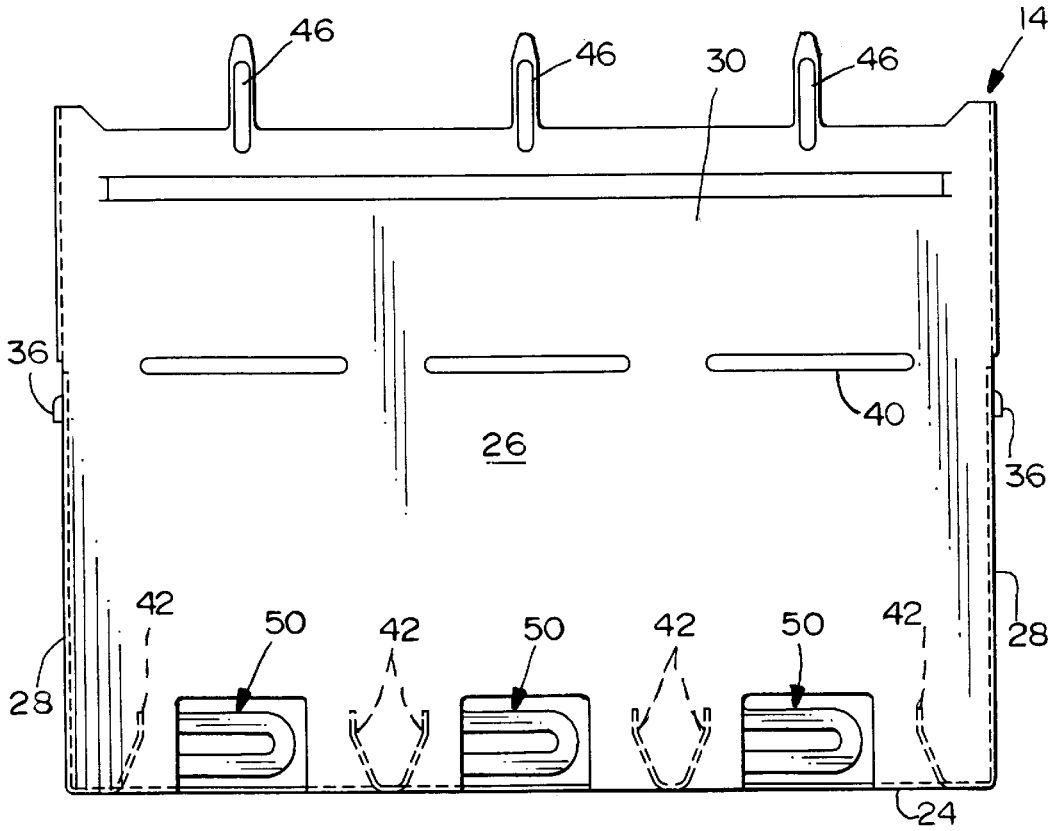
FIG. 5 is a top plan view of the unassembled shield.
Figure 6:
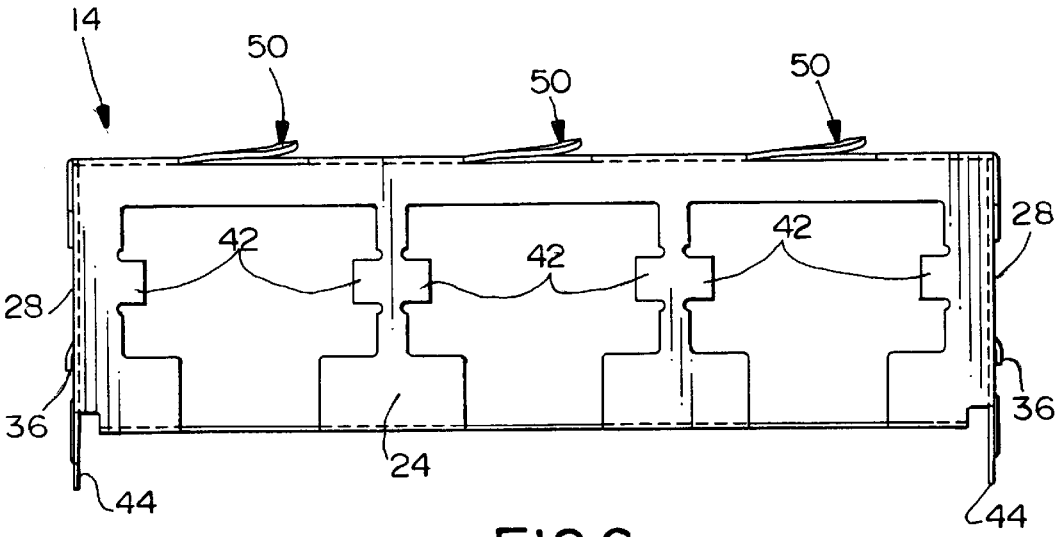
FIG. 6 is a front elevational view of the unassembled shield.
Figure 7:
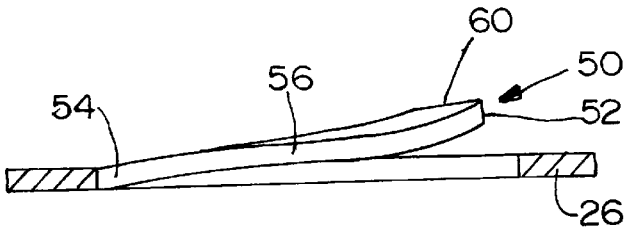
FIG. 7 is an enlarged fragmented section through a portion of the shield showing a front elevational view of one of the grounding tabs.
Figure 8:
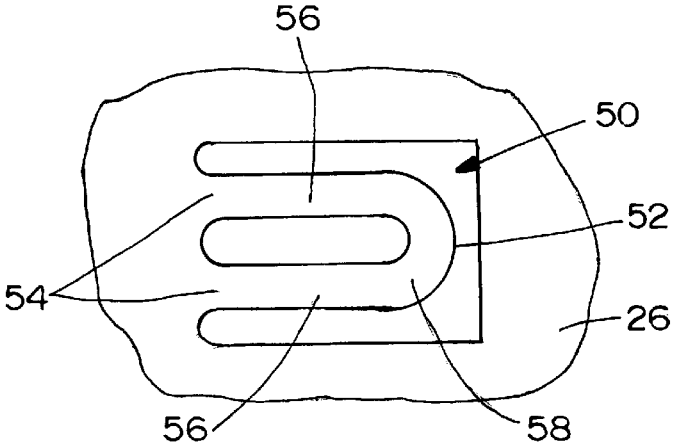
FIG. 8 is a top plan view of the grounding tab.
Figure 10:
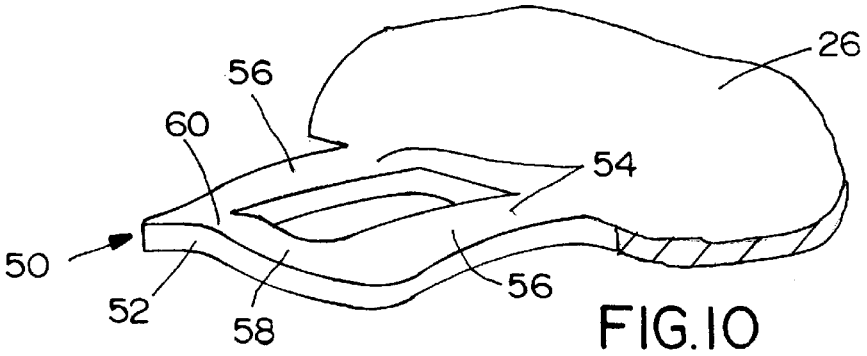
FIG. 10 is a perspective view of the grounding tab.
Figure 9:
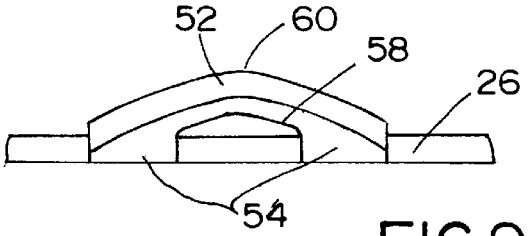
FIG. 9 is an elevational view looking toward the free or distal end of the grounding tab.

Referring to the drawings in greater detail, and first to FIGS. 1 and 2, the invention is embodied in a shielded electrical connector, generally designated 10, which includes a dielectric housing, generally designated 12, and a shield, generally designated 14. The housing is a unitary structure molded of dielectric material such as plastic or the like. The shield is a one-piece structure stamped and formed of conductive sheet metal material. As seen in FIG. 2, shielded electrical connector 10 is adapted for mounting to a printed circuit board 16 and is adapted to be secured within an opening 18 in a panel 20, such as a metal chassis housing.

Dielectric housing 12 of shielded connector 10 is of a generally rectangular block-shape and has at least one cavity 22 extending interiorly from a front mating face of the housing. The front mating face is not visible in FIG. 1, because it is substantially covered by a front mating face 24 of shield 14. Nevertheless, each cavity 22 is provided for receiving a complementary mating plug connector, such as a modular jack. Shielded connector 10 shown in the drawings is constructed with three cavities 22 for receiving three modular jacks, but it should be understood that the invention is applicable for a wide variety of connector configurations, including connectors with one or more than three cavities for receiving complementary mating connectors or plugs.

Referring to FIGS. 3–6 in conjunction with FIGS. 1 and 2, stamped and formed sheet metal shield 14 is shown in FIGS. 3–6 in an unassembled condition. The shield is of a generally rectangular box-shape for substantially covering the rectangular block-shaped housing 12 at least on the top, the rear and the sides of the housing. Specifically, shield 14 includes a generally planar top wall 26 and opposite, generally planar side walls 28, all extending rearwardly from front mating face or wall 24 of the shield. The shield includes a generally planar rear wall 30 which is shown most clearly in FIGS. 3 and 4 to initially be coextensive or coplanar with top wall 26 in an open or unassembled condition of the shield. The rear wall has flanges 32 at opposite side edges thereof, with the flanges having latch openings 34 for latching engagement with latch bosses 36 formed in side walls 28.

In assembly, block-shaped housing 12 is inserted into the rear of shield 14, with the shield in its unassembled condition shown in FIGS. 3–6, until the front mating face of the housing abuts behind front mating face or wall 24 of the shield, and the front of the housing rests on a lip 38 (FIGS. 3 and 4) which is bent rearwardly along the bottom edge of front wall 24. Rear wall 30 then is bent along a perforated line 40 (FIGS. 3 and 5) in the direction of arrows "A" (FIGS. 3 and 4), until latch openings 34 snap into latching engagement with latch bosses 36. The rear wall thereby securely holds the housing within the shield. Once assembled, the shield has a plurality of tabs 42 which extend rearwardly from front wall 24 into cavities 22 in housing 12. Tabs 42 can provide a latching function with the mating complementary connectors (modular jacks) and/or provide a grounding commoning function with the mating jack shields.

Once shield 14 is assembled about housing 12, connector 10 then is ready to be mounted on printed circuit board 16 and inserted into opening 18 in panel or chassis 20 (FIG. 2). To that end, side walls 28 of the shield are provided with legs 44 and rear wall 30 of the shield is provided with legs 46 for insertion into appropriate holes in printed circuit board 16. Legs 44 and 46 can function as mounting feet for the connector and/or the legs can be soldered to appropriate grounding circuit traces on the printed circuit board. Of course, it is understood that housing 12 mounts a plurality of electrical terminals or contacts for engaging appropriate terminals or contacts of the mating connectors or modular jacks, with the terminals or contacts being connected to appropriate signal circuits on the printed circuit board. The terminal or contacts are not shown in the drawings but are well known in the art.

The invention is directed to the provision of one or more grounding tabs, generally designated 50, for engaging metal chassis housing or panel 20 when connector 10 is inserted into opening 18 in the panel. As shown herein, one grounding tab 50 is provided for each plug-receiving cavity 22 of the connector. However, it should be understood that the invention contemplates any number of such grounding tabs for any one cavity or for the entire connector shield, as a whole. The grounding tabs can be placed in any of the top, side or bottom walls of the shield in position for engaging the metal chassis or panel 12 to common the connector shield to the chassis.

More particularly, referring to FIGS. 7–10 in conjunction with FIGS. 1–6, each grounding tab 50 is a cantilevered tab struck from a wall (e.g. top wall 26) of sheet metal shield 14. Each cantilevered tab has a free end 52 and a secured end 54. The free end extends from the secured end in a direction generally transverse to the direction of insertion of the connector into opening 18 in panel 20. This is quite different from the cantilevered grounding tabs of the prior art wherein the tabs extend in the insertion/removal direction of the connector, with the free ends of the prior art cantilevered tabs either extending away from the front face of the connector or toward the front face of the connector. The transverse tabs of the invention take up considerably less area of the shield wall except near the immediate front edge of the shield or connector. Therefore, the shield remains solid in covering the critical termination interfaces between the mating connector terminals to prevent leakage of radiated emissions.

Grounding tabs 50 of the invention also have a unique configuration. In particular, each cantilevered grounding tab is generally U-shaped defining a pair of leg portions 56 joined by a cross leg or bight portion 58. Adjacent ends of leg portions 56 define secured end 54 of the cantilevered tab, and bight portion 58 defines free end 52 of the tab. Bight portion 58 is rounded, as at 60 (FIGS. 9 and 10), and projects outwardly or upwardly of the plane of leg portions 56 and planar top wall 26 of the shield. Leg portions 56 extend generally parallel to front mating face or wall 24 of the shield.

With the above detailed description of grounding cantilevered tabs 50, it can be understood that upwardly projecting rounded portions 60 of the tabs are effective to establish a positive engagement with metal chassis or panel 20, within opening 18, as seen in FIG. 2. The tabs do not require the connector housing to be modified by recessing the housing to accommodate bent distal ends of the tabs as is required in the prior art to prevent buckling of the prior art tabs. The transverse, U-shaped grounding tabs of the invention are much less prone to buckling than the front-to-rear grounding tabs of the prior art. The U-shaped configuration of the tabs provide sort of a conforming action, wherein as one leg portion 56 tends to buckle during insertion or removal of the connector, the other leg portion resists such buckling, and the transverse orientation of the tab simply yields under skewed insertion forces until the tab is disposed in its securing position within the opening in the metal chassis or panel.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A shielded electrical connector adapted to be secured within an opening in a panel, comprising:

a dielectric housing having at least one cavity extending interiorly from a front mating face of the housing for receiving a complementary mating plug connector;

a shield stamped and formed from sheet metal material in a configuration to include a generally planar wall for embracing at least a top portion of the housing and insertable into the opening in the panel, a generally U-shaped cantilevered tab integrally formed from said wall of the sheet metal shield and having a secured end and a free end such that the free end extends from the secured end and flexes in a direction generally transverse to a direction of insertion of the connector into the panel; and said cantilevered tab defined by a pair of leg portions joined by a bight portion, with adjacent ends of the leg portions defining said secured end of the tab and the bight portion defining said free end of the tab.

2. The shielded electrical connector of claim 1 wherein said leg portions extend generally parallel to the front mating face of the dielectric housing.

3. The shielded electrical connector of claim 1 wherein said stamped and formed sheet metal shield comprises a one-piece structure.

4. The shielded electrical connector of claim 1 wherein said dielectric housing includes a plurality of said cavities for receiving a plurality of said mating plug connectors.

5. The shielded electrical connector of claim 1 wherein the connector is adapted for mounting to a printed circuit board, and said shield includes board-mounting means.

6. A shielded electrical connector adapted for mounting to a printed circuit board and adapted to be secured within an opening in a panel, comprising:

a dielectric housing having at least one cavity extending interiorly from a front mating face of the housing for receiving a complementary mating plug connector; and a one-piece shield stamped and formed of sheet metal material in a configuration to embrace at least a portion of the housing and including a generally planar wall insertable into the opening in the panel, and a cantilevered tab struck from said wall of the sheet metal shield and having a secured end and a free end such that the free end extends from the secured end in a direction generally transverse to a direction of insertion of the connector into the panel, the cantilevered tab being generally U-shaped defined by a pair of leg portions joined by a bight portion, with adjacent ends of the leg portions defining said secured end of the tab and the bight portion defining said free end of the tab, the bight portion being rounded and projecting outwardly of the plane of said wall of the shield, and the shield having means for grounding the shield to appropriate grounding traces on the printed circuit board.

7. The shielded electrical connector of claim 6 wherein said dielectric housing includes a plurality of said cavities for receiving a plurality of said mating plug connectors.

8. The shielded electrical connector of claim 6 wherein said leg portions extend generally parallel to the front mating face of the dielectric housing.

9. A shielded electrical connector adapted to be secured within an opening in a panel, comprising:

a dielectric housing; and a shield covering at least a top portion of the housing and including a generally U-shaped cantilevered grounding tab having a secured end and a free end such that the free end extends from the secured end and flexes in a direction generally transverse to a direction of insertion of the connector into the panel; and said cantilevered grounding tab defined by a pair of leg portions joined by a bight portion, with adjacent ends of the leg portions defining said secured end of the tab and the bight portion defining said free end of the tab.

10. The shielded electrical connector of claim 9 wherein said leg portions extend generally parallel to a front mating face of the connector.

11. A shielded electrical connector adapted to be secured within an opening in a panel, comprising:

a dielectric housing having at least one cavity extending interiorly from a front mating face of the housing for receiving a complementary mating plug connector; and a shield stamped and formed from sheet metal material in a configuration to include a generally planar wall for embracing at least a top portion of the housing and insertable into the opening in the panel, a generally U-shaped cantilevered tab integrally formed from said wall of the sheet metal shield defined by a pair of leg portions joined by a bight portion, with adjacent ends of the leg portions defining a secured end of the tab and the bight portion being rounded and projecting outwardly of the shield defining a free end of the tab and having a secured end and a free end such that the free end extends from the secured end in a direction generally transverse to a direction of insertion of the connector into the panel.

12. A shielded electrical connector adapted to be secured within an opening in a panel, comprising:

a dielectric housing; and a shield covering at least a top portion of the housing and including a generally U-shaped cantilevered grounding tab defined by a pair of leg portions joined by a bight portion, with adjacent ends of the leg portions defining a secured end of the tab and the bight portion being rounded and projecting outwardly of the shield defining a free end of the tab, the free end extending from the secured end in a direction generally transverse to a direction of insertion of the connector into the panel.

* * * * *